US007270726B2

(12) United States Patent
Ingelman et al.

(10) Patent No.: US 7,270,726 B2
(45) Date of Patent: Sep. 18, 2007

(54) METHOD FOR THE PRODUCTION OF GREEN LIQUOR

(75) Inventors: Magnus Ingelman, Karlstad (SE); Jan Tjernberg, Forshaga (SE); Anita Markusson, Molkom (SE)

(73) Assignee: Metso Fiber Karlstad AB, Karlstad (SE)

( * ) Notice: Subject to any disclaimer, the term of this patent is extended or adjusted under 35 U.S.C. 154(b) by 41 days.

(21) Appl. No.: 10/535,998

(22) PCT Filed: Nov. 21, 2003

(86) PCT No.: PCT/SE03/01806

§ 371 (c)(1),
(2), (4) Date: May 24, 2005

(87) PCT Pub. No.: WO2004/048681

PCT Pub. Date: Jun. 10, 2004

(65) Prior Publication Data

US 2006/0075900 A1 Apr. 13, 2006

(30) Foreign Application Priority Data

Nov. 25, 2002 (SE) ..... 0203478

(51) Int. Cl.
*D21C 11/04* (2006.01)

(52) U.S. Cl. ..... 162/30.11; 162/29

(58) Field of Classification Search ..... 162/30.11, 162/29, 30.1; 423/182, 183, 430, 432, DIG. 3
See application file for complete search history.

(56) References Cited

U.S. PATENT DOCUMENTS 1,691,511 A * 11/1928 Bates ..... 423/186
3,258,391 A * 6/1966 Cornell et al. ..... 162/30.11
3,523,864 A * 8/1970 Klei, Jr. et al. ..... 423/183
3,666,619 A * 5/1972 Mailhos et al. ..... 162/30.11
4,011,129 A * 3/1977 Tomlinson, II ..... 162/30.11
4,302,281 A * 11/1981 Ryham ..... 162/30.11
4,941,945 A * 7/1990 Pettersson ..... 162/29
5,213,663 A * 5/1993 Musow ..... 162/49
5,507,912 A * 4/1996 Lownertz ..... 162/30.11
5,607,548 A * 3/1997 Pettersson ..... 162/30.11
5,628,875 A * 5/1997 Liden et al. ..... 162/30.1
5,738,758 A * 4/1998 van Heiningen ..... 162/30.11
5,820,729 A * 10/1998 Ericsson et al. ..... 162/30.1
6,027,609 A * 2/2000 Nilsson ..... 162/30.1
6,074,521 A * 6/2000 Engdahl et al. ..... 162/29
6,190,633 B1 * 2/2001 Takahashi et al. ..... 423/432
2006/0075900 A1 * 4/2006 Ingelman et al. ..... 99/275

* cited by examiner

FOREIGN PATENT DOCUMENTS

WO WO 2004048681 A1 * 6/2004

*Primary Examiner*—Jose A. Fortuna
(74) *Attorney, Agent, or Firm*—Rolf Fasth; Fasth Law Offices

(57) ABSTRACT

The method is for production of green liquor in association with a causticizing process during recovery of chemicals in manufacture of sulphate pulp. A smelt (14) of chemicals principally consisting of Na2S and $Na_2CO_3$ from a soda boiler (1) is provided. Weak liquor (15) that contains dissolved NaOH and CaO is provided. A dissolving tank (2) is provided in which the smelt (14) from the soda boiler (1) is dissolved in the weak liquor (15) it order to form green liquor (16). A solution of NaOH is added to the weak liquor (15), at a position before the weak liquor (15) is added to the dissolving tank, in order to increase the concentration of NaOH in the weak liquor (15) such that a fraction of CaO that is presently dissolved in the weak liquor (15) precipitates.

8 Claims, 2 Drawing Sheets

| | |
|---|---|
| 0,725 | 25 |
| 1,675 | 20 |
| 3,75 | 15 |
| 25 | 8 |
| 100 | 5 |

METHOD FOR THE PRODUCTION OF GREEN LIQUOR

PRIOR APPLICATION

This application is a U.S. national phase application based on International Application No. PCT/SE2003/001806, filed 21 Nov. 2003, claiming priority from Swedish Patent Application No. 0203478-3, filed 25 Nov. 2002.

TECHNICAL AREA

The present invention concerns a method for the production of green liquor in association with a causticizing process during the recovery of chemicals in the manufacture of sulphate pulp. The method comprises the provision in a first step of a smelt of chemicals that principally consists of sodium sulphide ($Na_2S$) and sodium carbonate ($Na_2CO_3$) from a soda boiler; and the provision in a second step of a weak liquor that contains, among other compounds, dissolved sodium hydroxide (NaOH) and dissolved calcium oxide (CaO). Furthermore, the method comprises the provision in a third step of a dissolving tank in which the smelt from the soda boiler is dissolved in weak liquor in order to produce green liquor.

THE PRIOR ART

It has been known for a long time that, in factories for the manufacture of sulphate paper, pulp deposits, known as encrustations, in the process equipment lead to a reduction in the production capacity of the plant. The deposits can, for example, be constituted in boiler equipment and in evaporation equipment by calcium carbonate and sodium carbonate, or calcium sulphate and sodium sulphate, or by various compounds of silicon or aluminium. These substances arise partly from the process fluid, i.e. the white liquor, while precipitated substances from wood also contribute to the problems.

Deposits on process equipment in the chemical recovery system of the factory also cause a reduction in the degree of exploitation of the plant. For example, the deposits that are formed in the dissolver, where smelt from the soda boiler is dissolved in an aqueous solution known as weak liquor in order to form green liquor, give rise to a number of problems. It may be necessary, for example, to reduce the capacity of the soda boiler as a result of a reduced circulatory efficiency in the dissolver. Deposits in pipes and in pumps for the onwards transport of the green liquor from this tank can also contribute to reducing the degree of exploitation of the plant. A further negative effect of this is that it may not be possible in the worst case to maintain the density of the green liquor, which is an indirect measure of its chemical content, at a stable value, and the density may vary. This causes problems in the subsequent process steps which comprise, among other steps, slaking and causticizing, something that results in uneven quality of the white liquor.

U.S. Pat. No. 4,302,281 (1981) reveals a process for reducing the problems with precipitation and deposition in pulp-producing equipment by reducing the amount of inactive compounds, known as ballast compounds, in the white liquor. However, the document does not discuss the problem of deposits from weak liquor. Furthermore, this method results in the sludge that is formed also containing NaSH, which is also dissolved in the weak liquor, after which this NaSH in the weak liquor is oxidised, leading to an undesired ballast in the factory.

A process is revealed in U.S. Pat. No. 4,536,253 (1985) for the measurement of the properties of the white liquor in order thereby to make possible a more efficient use of chemicals while at the same time reducing problems caused by uneven quality of the while liquor. The problems that are described are wholly related to the quality of the white liquor and do not name any problems related to the addition of the weak liquor to the dissolver.

A process is described in U.S. Pat. No. 5,213,663 (1993) for the regulation of the concentration of sodium carbonate in the green liquor in the dissolving tank. This process constitutes an example of how the ability of the weak liquor to dissolve deposits that have already formed can be used, but the process does not tackle the root of the problem, i.e. preventing or minimising the formation of deposits.

Another process that deals with the problem of deposits from green liquor in the dissolving tank and in pipes connected to it and in other equipment for transport of green liquor is described in U.S. Pat. No. 5,820,729 (1998). This process is a further example of how the ability of weak liquor to dissolve deposits is used, but, neither does this document present a method for the prevention or minimisation of the formation of these.

Furthermore, it is previously known through, among other sources, an article of W. J. Frederick Jr. and Rajeev Krishnan "Pirssonite deposits in green liquor processing", published in the TAPPI Journal in February 1990, that pirssonite deposits in the dissolver can be reduced by allowing the sludge to be transported from the sludge wash together with the weak liquor. The method, however, generates an undesirable loss of sludge since the particles that are transported from the sludge wash are led to the dissolver for subsequent separation and dumping as sludge from the green liquor clarification/filtration, rather than being led to the sludge oven in order to be further processed to quicklime CaO.

BRIEF DESCRIPTION OF THE INVENTION

It is one aim of the present invention to offer a method that essentially eliminates or at least minimises a number of the negative effects that are caused by deposits in the dissolving tank. This is achieved through the addition of a solution of sodium hydroxide to the weak liquor at a position before the weak liquor is added to the dissolving tank, in order in this way to increase the concentration of sodium hydroxide in the weak liquor such that a fraction of the calcium oxide that is dissolved in the weak liquor precipitates.

The invention allows the degree of exploitation of the chemical recovery to be maintained at a high level both with respect to the soda boiler and the production of green liquor in the dissolver. Availability also increases in that the maintenance requirement is reduced as a result of the lower degree of deposits in the dissolver and on the pipes, pumps and other equipment that is normally exposed and requires cleaning, either mechanical, chemical or a mixture of both, at regular intervals.

The invention can be explained in that there are two types of deposits in the dissolver and in pumps and pipes connected to it. One type is constituted by pirssonite, $Na_2Ca(CO_3)_2\text{-}2H_2O$. This type of deposit is well-known and arises principally as a result of too high a density of the green liquor. It is for this reason important to monitor carefully the density on exit from the dissolver. The second type is constituted by calcium carbonate, $CaCO_3$, which deposits have until now not received attention to the same degree as pirssonite. These deposits can be caused by the fact that the content of dissolved sodium hydroxide in the weak liquor nowadays can be very low, typically 5-10 g/l. The content of calcium oxide dissolved in the weak liquor can, at these low levels of sodium hydroxide, be significant. One reason for low levels of sodium hydroxide is the presence in modern plants of efficient filters for the separation of white liquor and sludge. This results in most of the alkali being removed as white liquor, with very little accompanying the sludge and arriving at the weak liquor. In older causticizing plants, on the other hand, the level of sodium hydroxide in the weak liquor was significantly higher, typically >20 g/l. The solubility of calcium oxide in weak liquor is, however, very low at such a concentration of sodium hydroxide, indeed, it is essentially zero. Thus, addition of weak liquor did not cause the formation of such deposits in the dissolving tank, at least, not to such a degree that negative results from the deposits arose.

The advantage is achieved through the invention that the dissolved calcium oxide is precipitated before the weak liquor reaches the green liquor in the dissolver. For this reason, the calcium oxide cannot give rise to deposits/"encrustations" in the dissolver or in subsequent pumps and pipes. Furthermore, a synergistic effect is at the same time achieved in that the precipitated particles form "growing surfaces", which ensure that any pirssonite that does form does not precipitate onto the surfaces of the equipment, but rather on the "growing surfaces".

A further advantage is achieved with the invention in that the concentration of sodium hydroxide in the weak liquor from the washed sludge is maintained at a level below 20 g/l, preferably under 15 g/l and even more preferably under 10 g/l before any addition of sodium hydroxide is carried out, and in that the addition of sodium hydroxide to the weak liquor is carried out at such a level that the concentration of sodium hydroxide in the weak liquor increases at least 20%, preferably at least 40% and even more preferably at least 60%. This contributes to a more efficient use of the sodium hydroxide than that achieved by older processes in which the concentration of sodium hydroxide in the weak liquor is naturally high through the higher content of sodium hydroxide in the sludge.

BRIEF DESCRIPTION OF FIGURES

The invention will be described in more detail with reference to the attached drawings where.

DETAILED DESCRIPTION OF FIGURES

Figure 1:
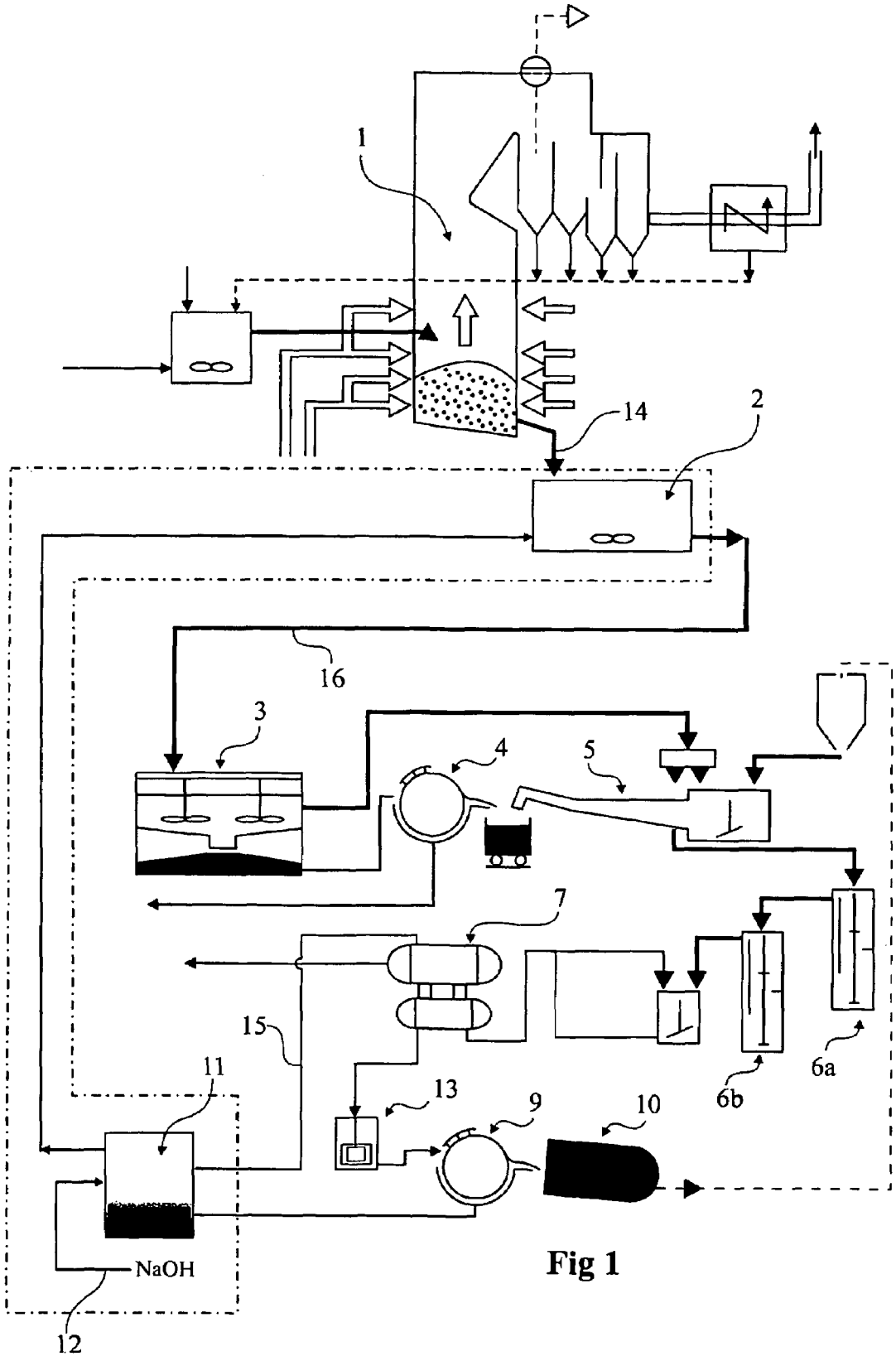
FIG. 1 shows a flow diagram of a section of a causticizing plant in which the invention is used.

FIG. 1 shows a flow diagram of a plant for chemical recovery in a sulphate pulp factory. The figure also shows schematically how the invention is used in one preferred embodiment. The chemical recovery comprises the following equipment: soda boiler 1, dissolver 2, green liquor clarifier 3, sludge filter 4, lime slaker 5, causticizing vessel 6*a*, 6*b*, white liquor filter 7, sludge filter (atmospheric) 9, and sludge oven 10. In addition to this equipment there are pipes, pumps, tanks, measurement equipment, regulator equipment and other equipment that is well-known to one skilled in the arts.

The soda boiler 1 is a steam boiler that has been adapted to burn black liquor. It is also a chemical reactor and it constitutes the first step in the conversion of chemicals recovered in the pulp washing to new cooking chemicals. The liquor after evaporation (thick liquor) is sprayed into the oven of the soda boiler through special nozzles. Air for combustion is blown in, and the liquor is dried by the hot exhaust gases, forming a bed in the bottom of the oven. The organic matter is vaporised in this bed, and is exhaustively combusted at a higher level in the oven. Carbon dioxide that is produced forms sodium carbonate ($Na_2CO_3$)—soda—with a fraction of the sodium present in the dry matter, and it is this that has led to the soda boiler being so named. Sodium sulphate ($Na_2SO_4$) formed, together with any sodium sulphate that may be added as make-up chemical, is converted by reduction with the aid of carbon in the carbonised dry matter to sodium sulphide ($Na_2S$). Sodium sulphide is an active cooking chemical.

Sodium carbonate ($Na_2CO_3$), sodium sulphide ($Na_2S$) and some ballast chemicals run out from the bottom of the oven in the form of smelt 14, down into the dissolver 2. The smelt 14 is there dissolved in what is known as weak liquor 15 from the white liquor preparation and is then called green liquor 16. The green liquor 16 from the soda boiler 1 passes onwards to the white liquor preparation, which is the final process step in the recovery system. The sodium sulphide in the smelt 14 is present in the green liquor 16 as sodium hydroxide and sodium hydrogen sulphide. These substances pass through the white liquor preparation without, in principle, being modified. The sodium carbonate must be converted to sodium hydroxide. Most of the sodium hydroxide in the white liquor is formed in this conversion process.

Green liquor 16 from the dissolver 2 is first cleaned of contaminants in the form of sludge. This takes place in the chart in FIG. 1 in the green liquor clarifier 3, which separates out the sludge through sedimentation. Pressure filters have also recently begun to be used. A newly developed piece of apparatus is a tube filter known as a "cassette filter". Green liquor 16 that remains in the separated sludge is washed out through a sludge filter 4. The filtrate (weak liquor) is pumped to the dissolver 2 of the soda boiler 1.

The cleaned green liquor 16 passes to the lime slaker 5 in which it is mixed with quicklime. The water in the green liquor 16 reacts with the lime, which becomes calcium hydroxide. Sand and unreacted fragments of lime are scraped out and taken away to a landfill. The "causticization reaction" also commences in the slaker. The mixture of liquor and lime passes from the lime slaker 5 to several causticization vessels 6*a*, 6*b*, connected in series. The reaction between sodium carbonate and calcium hydroxide continues there. The products are sodium hydroxide and calcium carbonate ($CaCO_3$). Sodium hydroxide is also known as caustic soda, and this is the reason that the reaction is known by the name "causticizing". Only approximately 80% of the sodium carbonate can be converted to sodium hydroxide since the reaction is an equilibrium reaction.

After the causticizing, sodium hydroxide has been reformed and the liquor is once again white liquor. The other reaction product, calcium carbonate, which is also known as sludge, must be removed before the liquor can be used. The white liquor is ready to be reused in the digester once the sludge has been removed.

The separation of the sludge, clarification of the white liquor, takes place in modern filter equipment using pressure disc filters. The sludge that is separated is often washed partially in the disc filter using, for example, hot water. This takes place using a spray from washing nozzles inside the filter. Separated sludge can then be diluted with, for example, condensate from evaporation or with hot water.

The washed and diluted sludge is stored in a storage tank. It is pumped from there to a sludge filter 9 of vacuum drum type. Final washing takes place there, and drying to a value of approximately 75% dry matter. The sludge is then transferred onwards to a sludge oven 10 in which it is reburned to lime. The sludge oven 10 is a rotation oven that comprises a long, slightly inclined tube. The sludge is fed into the upper end of the oven. Fuel, which may be oil, gas, pine oil, methanol from cleaning of the condensate or biofuel, is added at the lower end. Sludge is fed downwards towards the combustion zone, where the temperature is approximately 1 200° C., by the rotation. Drying, calcination (i.e. conversion of the calcium carbonate to calcium oxide), and sintering take place in the oven. In this way, the closed cycle of lime recovery is complete.

In order to apply the invention, it is principally the dissolver 2 and a tank 11 for weak liquor 15 that are the equipment that is taken into service in order to apply the invention, something that has also been shown in FIG. 1 within the dashed region. It is to be understood that it can be an advantage if this tank 11 is constituted by a storage tank that already exists for the storage of weak liquor 15, but a new tank may, of course, be installed for this function. In the method that is relevant for the invention, washing fluid from the sludge wash 8 and from the green liquor sludge wash 4 form a weak liquor that is led to the dissolver 2. Various forms of process water, such as condensate from the evaporation plant, for example, or hot water, may also be added to the weak liquor. A sludge with a low concentration of NaOH is obtained in causticizing plants in which modern high-yield filters have been installed as white liquor clarifiers 7 for separating the sludge from the white liquor. The solubility of calcium oxide depends heavily on the concentration of sodium hydroxide in the weak liquor 15, and a low level of NaOH makes a high level of CaO possible. This relationship is shown in the diagram in FIG. 2.

A pipe 12 is connected to the tank 11 for the addition of sodium hydroxide to the tank. By adding sodium hydroxide to the weak liquor 15 in such an amount that the concentration of sodium hydroxide in the weak liquor 15 increases by at least 20%, preferably at least 40%, and most preferably at least 60%, can fractions of the calcium oxide in the weak liquor 15 be precipitated out. The precipitate is constituted by calcium hydroxide ($Ca(OH)_2$), and $Ca(OH)_2$ can be converted to calcium carbonate $CaCO_3$ in solid form, depending on the composition of the weak liquor 15. This precipitation takes place preferably in the tank 11 and the addition of sodium hydroxide is preferably arranged in such a manner that the precipitation takes place as small particles in the solution. It is an advantage if these small particles are allowed to accompany the weak liquor 15 to the dissolver 2 in order there to form growing surfaces for the precipitation of the remaining quantity of calcium oxide in the weak liquor 15. A certain amount of calcium oxide can be separated out by sedimentation, depending on how much calcium oxide has been precipitated in the tank 11. The separated precipitate can be led onwards to the sludge silo 13, in order in this way to pass onwards to the sludge oven 10 for conversion to quicklime. If it is decided to allow the particles to pass to the dissolver, it is an advantage if the weak liquor tank 11 is provided with a stirrer.

Figure 2:
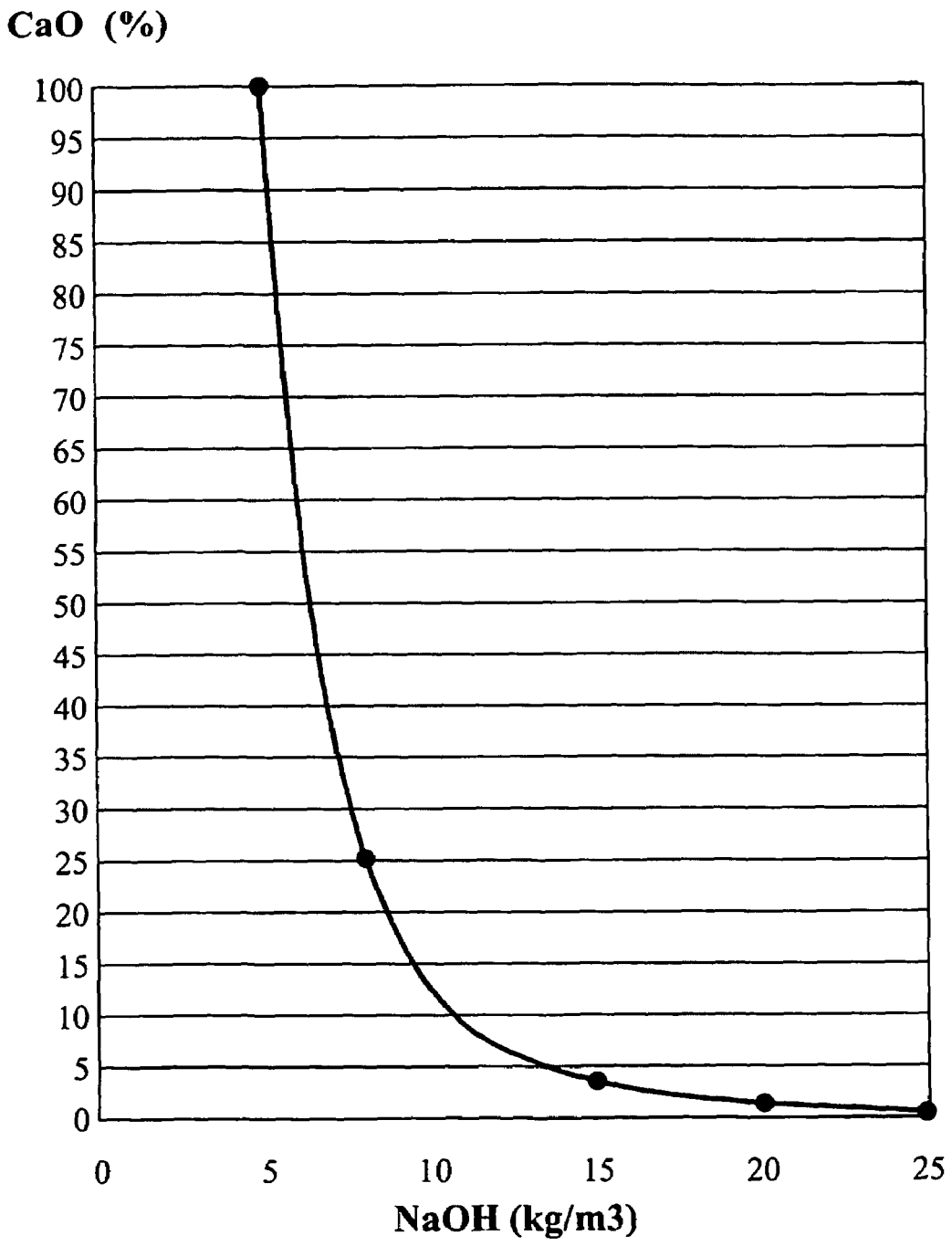
FIG. 2 shows a diagram of the solubility of calcium oxide (CaO) as a function of the concentration of sodium hydroxide (NaOH).

As can be seen in the diagram in FIG. 2, addition of sodium hydroxide (NaOH) to the weak liquor 15 will have effects on the precipitation of calcium oxide (CaO) of different magnitude, depending on the concentration of NaOH in the weak liquor 15 prior to the addition of NaOH. Greatest effect is achieved for weak liquors having a low concentration of NaOH, where the solubility of CaO is high. The invention is thus particularly suitable where the concentration of NaOH in the weak liquor 15 in the weak liquor tank 11 lies below 10 g/l before any addition of NaOH is carried out. However, weak liquors with NaOH concentrations up to 20-25 g/l can also be given an addition of further NaOH, although the effect of this addition will not in this case be as great.

For example, in weak liquors with an NaOH concentration of 5 g/l, an increase of the level to 8 g/l will cause 30 g $CaO/m^3$ to be precipitated, given that the weak liquor was saturated with CaO before the addition. This precipitation corresponds to approximately 75% of the total amount of dissolved CaO in the weak liquor. If the weak liquor rather has an NaOH concentration of 10 g/l, an increase to 13 g/l will lead to the precipitation of approximately 3 g $CaO/m^3$ weak liquor. A weak liquor with an NaOH concentration of 15 g/l will give a precipitation of approximately 1 g $CaO/m^3$ weak liquor when the concentration is increased to 18 g/l.

In one example in which the invention is used in one preferred embodiment in a sulphate pulp factory, the production of green liquor amounts to 5,000 $m^3$ per day. Weak liquor is obtained from the sludge wash with a temperature of 70° C. and with an NaOH concentration of 5 $kg/m^3$. This weak liquor can theoretically dissolve 40 g $CaO/m^3$. If the NaOH concentration is increased to 8 $kg/m^3$ by the active addition of NaOH, in, for example, the weak liquor tank 11, without the temperature of the weak liquor being changed, then 75% of the dissolved CaO will be precipitated. The remaining 25%, which corresponds to 10 g CaO $/m^3$, remains dissolved in the weak liquor and will be precipitated when the weak liquor is added to the dissolver 2. In the absence of preparation of the weak liquor according to the invention, 200 kg of CaO per day is precipitated in the dissolver, while 150 kg will be precipitated in the weak liquor tank 11 in the form of small particles of calcium hydroxide ($Ca(OH)_2$) and calcium carbonate ($CaCO_3$) when using the invention according to the example given above. The remaining 50 kg will be precipitated in the dissolver and preferably onto the precipitated particles that have been allowed to accompany the weak liquor from the weak liquor tank 11.

The solubility of CaO in the weak liquor 15 depends on its temperature, in addition to the concentration of NaOH, in such a manner that the solubility decreases with increased temperature. The invention also comprises the use of this relationship in order to precipitate CaO. It is thus possible to precipitate CaO by increasing the temperature of the weak liquor 15. The method is, however, limited in that the temperature of the weak liquor 15 when it is led to the dissolver 2 must lie at such a level that boiling is avoided in the dissolver 2. It is thus an advantage when using the invention that the temperature of the weak liquor 15 is taken into consideration.

In order to use the method for precipitating CaO that is described above, a separate step can be arranged in one variant of the invention in which the temperature is raised during a first phase in order to precipitate CaO, after which the weak liquor 15 is in a later phase cooled to a temperature suitable for its addition to the dissolver 2. It is possible that precipitated $Ca(OH)_2$ must be separated from the weak liquor before the cooling phase, in order to prevent it redisolving.

The invention is not limited to that which has been described above, but can be varied within the framework of the attached claims. For example, it will be apparent that sodium hydroxide can be added to the weak liquor 15 at another position than at the tank 11. It is appropriate that sodium hydroxide is added to the weak liquor after the green liquor sludge has been separated at the sludge filter, or the sludge has been separated from the sludge filter. It may, for example, be advantageous to establish a separate tank for this purpose when it is desired to remove a part of the precipitate through sedimentation. It is, naturally, possible to separate the precipitate from the weak liquor 15 by other separation methods familiar to one skilled in the arts, by filtering, for example, but it is to be understood that how this is accomplished is not a significant characteristic of the invention.

It will be apparent with reference to the diagram in FIG. 2 that the invention can also be used for weak liquors with concentrations of sodium hydroxide that approach 25 g/l.

The addition to the weak liquor 15 is preferably constituted by a solution of sodium hydroxide, but one skilled in the arts will realise that the invention also allows the addition to be constituted by other alkali solutions such as, for example, white liquor, green liquor, or a mixture of these solutions.

It is also conceivable within the innovative concept of the invention to add the sodium hydroxide to one of the filtrates that will constitute part of the weak liquor. It is preferable that this filtrate has no, or a very low, content of CaO, in order to prevent precipitation of $Ca(OH)_2$.

It is advantageous if the addition of alkali to the weak liquor 15 is carried out in a tank, but the innovative concept also comprises an addition of alkali in the line that transports weak liquor 15 to the dissolver 2. It is also conceivable to arrange the addition in the dissolver 2 above the fluid surface such that the precipitation takes place at this location. In this case, however, if these positions for the addition are selected, the advantage is not achieved, or the possibility is made more difficult, to preserve the precipitate for recovery of chemicals.

While the present invention has been described in accordance with preferred compositions and embodiments, it is to be understood that certain substitutions and alterations may be made thereto without departing from the spirit and scope of the following claims.

The invention claimed is:

1. A method for the production of green liquor in association with a causticizing process during recovery of chemicals during the manufacture of sulphate paper pulp, comprising:

providing a smelt of chemicals consisting essentially of $Na_2S$ and $Na_2CO_3$ from a soda boiler, conveying the smelt from a soda boiler to a dissolving tank, providing a weak liquor in a vessel that contains dissolved NaOH and CaO, the weak liquor having a first concentration of NaOH of not higher than 25 g/l, adding a solution of NaOH to the weak liquor in the vessel in such an amount that the first concentration of NaOH in the weak liquor increases to a second concentration of NaOH that is at least 20% higher than the first concentration and until a main portion of the dissolved CaO starts precipitating into particles in the weak liquor, conveying the weak liquor and the particles to the dissolving tank, and dissolving the smelt in the weak liquor in the dissolving tank to form a green liquor.

2. The method according to claim 1 wherein the temperature of the weak liquor lies in an interval of 20-80° C.

3. The method according to claim 1, wherein the weak liquor is obtained from a process of washing a sludge.

4. The method according to claim 1. wherein the weak liquor is obtained from a process of washing a green liquor sludge.

5. The method according to claim 1, wherein NaOH is added to the weak liquor in the vessel, such that a main portion of the CaO in the weak liquor in the vessel precipitates as particles in the vessel and that any remaining dissolved CaO precipitates in the dissolver tank on the surface of the particles.

6. The method according to claim 5 wherein at least a fraction of the particles is removed from the weak liquor before the weak liquor is led onwards to dissolving tank.

7. The method according to claim 1 wherein the NaOH that is added to the weak liquor is added at such a temperature that a temperature of the weak liquor is essentially maintained.

8. The method according to claim 1 wherein the NaOH that is added to the weak liquor is added at such a temperature that a temperature of the weak liquor increases.

* * * * *